US009570259B2

(12) United States Patent
Hasegawa et al.

(10) Patent No.: US 9,570,259 B2
(45) Date of Patent: Feb. 14, 2017

(54) ELECTROMAGNETIC RELAY

(71) Applicant: FUJITSU COMPONENT LIMITED, Tokyo (JP)

(72) Inventors: Yoichi Hasegawa, Tokyo (JP); Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/798,595

(22) Filed: Jul. 14, 2015

(65) Prior Publication Data

US 2016/0027602 A1 Jan. 28, 2016

(30) Foreign Application Priority Data

Jul. 28, 2014 (JP) ..... 2014-152870

(51) Int. Cl.

| | |
|---|---|
| ***H01H 51/22*** | (2006.01) |
| ***H01H 50/58*** | (2006.01) |
| *H01H 9/44* | (2006.01) |
| *H01H 50/64* | (2006.01) |
| *H01H 11/06* | (2006.01) |
| *H01H 1/54* | (2006.01) |

(52) U.S. Cl.

CPC ..... *H01H 50/58* (2013.01); *H01H 51/2236* (2013.01); *H01H 51/2272* (2013.01); *H01H 9/443* (2013.01); *H01H 50/643* (2013.01); *H01H 2001/545* (2013.01); *H01H 2011/067* (2013.01); *H01H 2205/002* (2013.01)

(58) Field of Classification Search

CPC . H01H 50/58; H01H 51/2236; H01H 51/2254
USPC ..... 335/78–86
See application file for complete search history.

(56) References Cited

U.S. PATENT DOCUMENTS

2002/0036557 A1 3/2002 Nakamura et al.
2009/0322454 A1 12/2009 Tanaka et al.
(Continued)

FOREIGN PATENT DOCUMENTS

EP 2 672 497 A1 12/2013
JP 6-139891 5/1994
(Continued)

OTHER PUBLICATIONS

Patent Abstracts of Japan, Publication No. 2013-41815, published Feb. 28, 2013.
(Continued)

*Primary Examiner* — Ramon M Barrera
(74) *Attorney, Agent, or Firm* — Staas & Halsey LLP

(57) ABSTRACT

An electromagnetic relay includes: a pair of fixed contact terminals, each of which has a fixed contact; a movable contact spring having a pair of movable pieces and a coupler coupling the pair of movable pieces, each of the movable pieces having a movable contact that contacts and is separated from the fixed contact; an armature having a flat plate to be adsorbed to an iron core and a hanging portion bent from the flat plate and extending downward, and moves the movable contact spring by a rotation operation; and an electromagnetic device driving the armature, wherein the hanging portion has a projection to fix the movable contact spring on a face thereof facing the electromagnetic device and a pulling portion that extends downward more than the projection and pulls the movable contact spring when a current flows between the fixed contact and the movable contact.

7 Claims, 12 Drawing Sheets

(56) References Cited

U.S. PATENT DOCUMENTS

| | | | |
|---|---|---|---|
| 2010/0066468 | A1 | 3/2010 | Iwamoto et al. |
| 2013/0021121 | A1 | 1/2013 | Uchida |
| 2013/0021122 | A1 | 1/2013 | Uchida |
| 2014/0015627 | A1 | 1/2014 | Uchida |
| 2014/0035705 | A1 | 2/2014 | Uchida |
| 2015/0048908 | A1 | 2/2015 | Isozaki et al. |

FOREIGN PATENT DOCUMENTS

| | | |
|---|---|---|
| JP | 8-2906 | 1/1996 |
| JP | 2002-100275 | 4/2002 |
| JP | 2010-10056 | 1/2010 |
| JP | 2010-73323 | 4/2010 |
| JP | 2012-199112 | 10/2012 |
| JP | 2012-199133 | 10/2012 |
| JP | 2012-256482 | 12/2012 |
| JP | 2013-25906 | 2/2013 |
| JP | 2013-41815 | 2/2013 |
| JP | 2013-80692 | 5/2013 |
| JP | 2013-84425 | 5/2013 |

OTHER PUBLICATIONS

Patent Abstracts of Japan, Publication No. 2013-25906, published Feb. 4, 2013.
Patent Abstracts of Japan, Publication No. 2012-256482, published Dec. 27, 2012.
Patent Abstracts of Japan, Publication No. 2013-84425, published May 9, 2013.
Patent Abstracts of Japan, Publication No. 2012-199112, published Oct. 18, 2012.
Patent Abstracts of Japan, Publication No. 2010-10056, published Jan. 14, 2010.
Patent Abstracts of Japan, Publication No. 2012-199133, published Oct. 18, 2012.
Patent Abstracts of Japan, Publication No. 2002-100275, published Apr. 5, 2002.
Patent Abstracts of Japan, Publication No. 6-139891, published May 20, 1994.
Patent Abstracts of Japan, Publication No. 2010-73323, published Apr. 2, 2010.
J-PlatPat English Abstract, Publication No. 2013-080692 published May 2, 2013.
Korean Office Action dated Sep. 22, 2016 in corresponding Korean Patent Application No. 10-2015-0082504.

ELECTROMAGNETIC RELAY

CROSS-REFERENCE TO RELATED APPLICATION

This application is based upon and claims the benefit of priority of the prior Japanese Patent Application No. 2014-152870 filed on Jul. 28, 2014, the entire contents of which are incorporated herein by reference.

FIELD

A certain aspect of the embodiments is related to an electromagnetic relay.

BACKGROUND

It is known that an electromagnetic repulsion force may occur at a contact spot between a movable contact and a fixed contact of an electromagnetic relay because of a direction of a current flowing between the movable contact and the fixed contact. The electromagnetic repulsion force operates such that the movable contact gets away from the fixed contact. Therefore, there is known electromagnetic relays to generates a contact force of a movable contact and a fixed contact during energization of an overcurrent (for example, see Japanese Laid-open Patent Publications No. 2013-41815, No. 2013-25906, No. 2012-256482, No. 2013-84425, No. 2012-199112, No. 2010-10056 and No. 2012-199133 and Japanese Laid-open utility model Publication No. 8-2906). And, there is known an electromagnetic relay that has a divided movable spring and an armature (for example, see Japanese Laid-open Patent Publication No. 2002-100275).

SUMMARY

According to an aspect of the present invention, there is provided an electromagnetic relay including: a pair of fixed contact terminals, each of which has a fixed contact; a movable contact spring that has a pair of movable pieces and a coupler that couples the pair of movable pieces, each of the pair of movable pieces having a movable contact that contacts and is separated from the fixed contact; an armature that has a flat plate to be adsorbed to an iron core and a hanging portion bent from the flat plate and extending downward, and moves the movable contact spring by a rotation operation; and an electromagnetic device that drives the armature, wherein the hanging portion has a projection to fix the movable contact spring on a face thereof facing the electromagnetic device and a pulling portion that extends downward more than the projection and pulls the movable contact spring when a current flows between the fixed contact and the movable contact.

According to another aspect of the present invention, there is provided an electromagnetic relay including: a pair of fixed contact terminals, each of which has a fixed contact; a connection plate that has a pair of movable contacts, each of which contacts and is separated from the fixed contact; a plate spring to which the connection plate is fixed; an armature that has a flat plate to be adsorbed to an iron core and a hanging portion bent from the flat plate and extending downward, and moves the connection plate and the plate spring by a rotation operation; and an electromagnetic device that drives the armature, wherein the hanging portion has a projection to fix the plate spring on a face thereof facing the electromagnetic device and a pulling portion that extends downward more than the projection and pulls the plate spring and the connection plate when a current flows between the fixed contact and the movable contact.

According to another aspect of the present invention, there is provided an electromagnetic relay including: a fixed contact terminal that has a fixed contact; a connection plate that has a movable contact contacting and separated from the fixed contact; an electromagnet; and an armature that has an adsorbing portion to be adsorbed to an iron core provided in the electromagnet and a hanging portion extending downward from the adsorbing portion, and moves the connection plate by a rotation operation according to an excitation of the electromagnet, wherein: the connection plate is fixed to a face of the hanging portion that is opposite to another face of the hanging portion facing the fixed contact terminal; the hanging portion has an extension portion that extends from a position to which the connection plate is fixed toward a position at which the movable contact of the connection plate is provided; and a clearance is formed between the extension portion and the connection plate when the movable contact separates from the fixed contact.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

The above-mentioned electromagnetic relays generate a contact force between a movable contact and a fixed contact during energization of an overcurrent. However, current paths are formed around the fixed contact and the movable contact. Therefore, there is a problem that the electromagnetic relays have a large size. Moreover, new components (for example, an iron piece) to generate the contact force between the movable contact and the fixed contact are attached to a fixed terminal or a movable spring. Therefore, the number of components increases. And there is a problem that a manufacturing cost increases.

A description will now be given of embodiments of the present invention with reference to the drawings.

Figure 1:
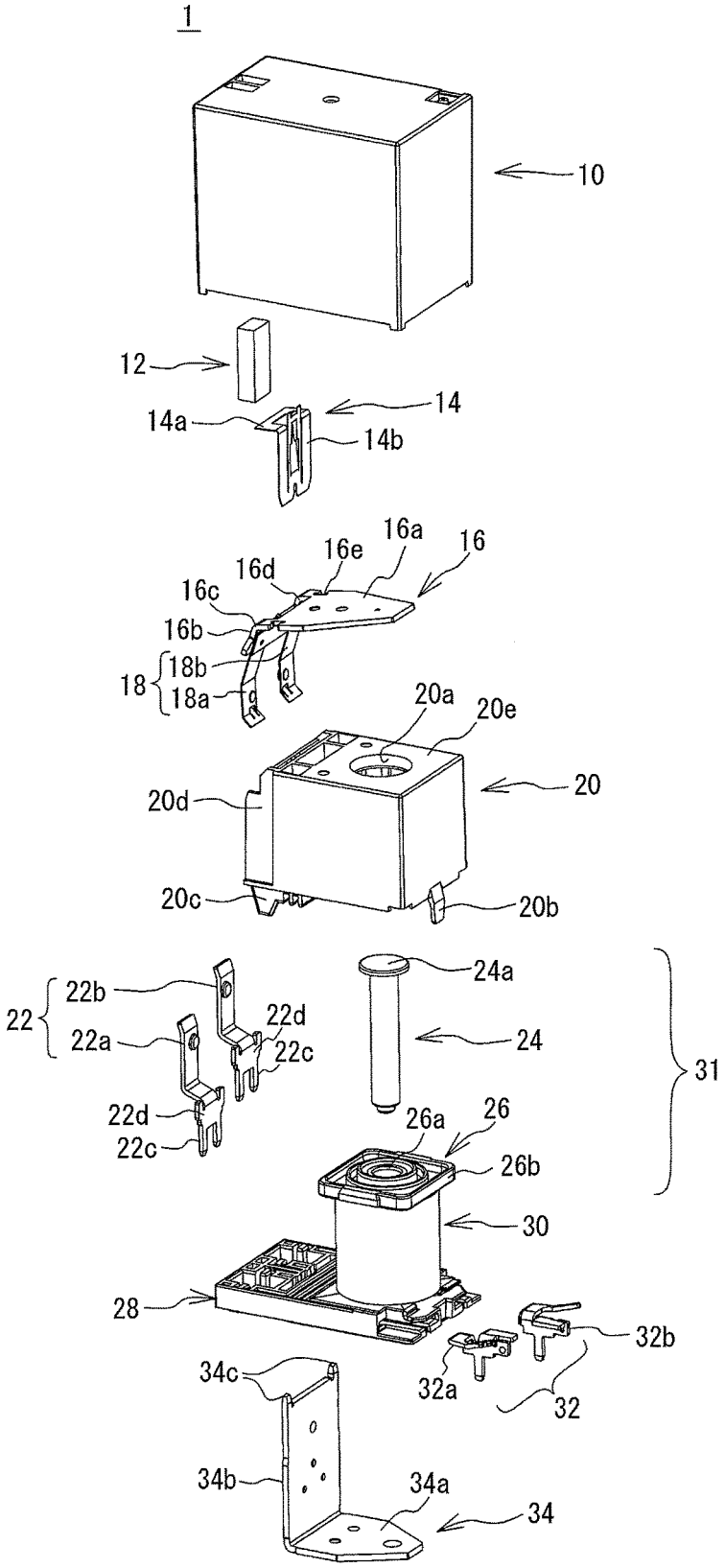
FIG. 1 illustrates an exploded view of an electromagnetic relay (a relay) in accordance with a first embodiment.
Figure 2:
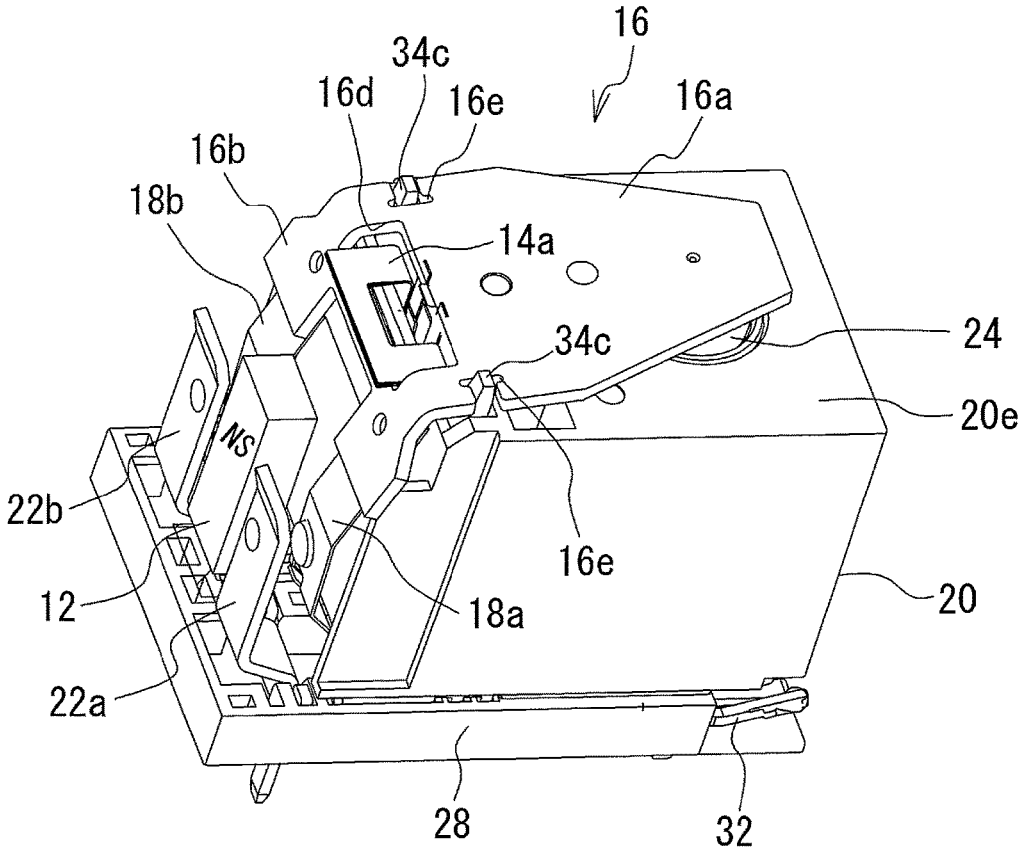
FIG. 2 illustrates a perspective view of a relay.

FIG. 1 illustrates an exploded view of an electromagnetic relay (hereinafter referred to as a relay) in accordance with a first embodiment. FIG. 2 illustrates a perspective view of the relay.

A relay 1 in accordance with the first embodiment is a relay that handles a high voltage of a direct current. For example, the relay 1 is used as a relay for battery pre-charge (for preventing an inrush current to a main relay contact) of an electric car. The high voltage of a direct current does not mean a high voltage regulated by IEC (International Electrotechnical Commission) but means a voltage more than 12 VDC or 24 VDC used in a general electric car.

It is necessary for the relay 1 to surely extinguish an arc generated between a fixed contact and a movable contact at a shutting off of a load of a high voltage of a direct current. With respect to a general relay handling a high voltage of a direct current, a polar character is designated to a connection of a load side. However, in the relay 1 acting as a relay for a battery pre-charge, a current direction is reversed during a battery charge and during a discharge. Therefore, it is necessary not to designate a polar character of the connection of the load side. Accordingly, it is necessary for the relay 1 to extinguish an arc despite the direction of the current flowing between the movable contact and the fixed contact. A use application of the relay 1 is not limited to an electric car. But, the relay 1 can be used for various devices or various facilities.

As illustrated in FIG. 1, the relay 1 has a case 10, a permanent magnet 12 for extinguishing a magnetism, a hinge spring 14, an armature 16, a movable contact spring 18, an insulating cover 20, fixed contact terminals 22 (22*a* and 22*b*), an iron core 24, a spool 26, a base 28, a coil 30, a pair of coil terminals 32 (32*a* and 32*b*) and a yoke 34, The pair of coil terminals 32 (32*a* and 32*b*) supplies a current for exciting an electromagnet structured with the iron core 24, the spool 26 and the coil 30.

Figure 3A:
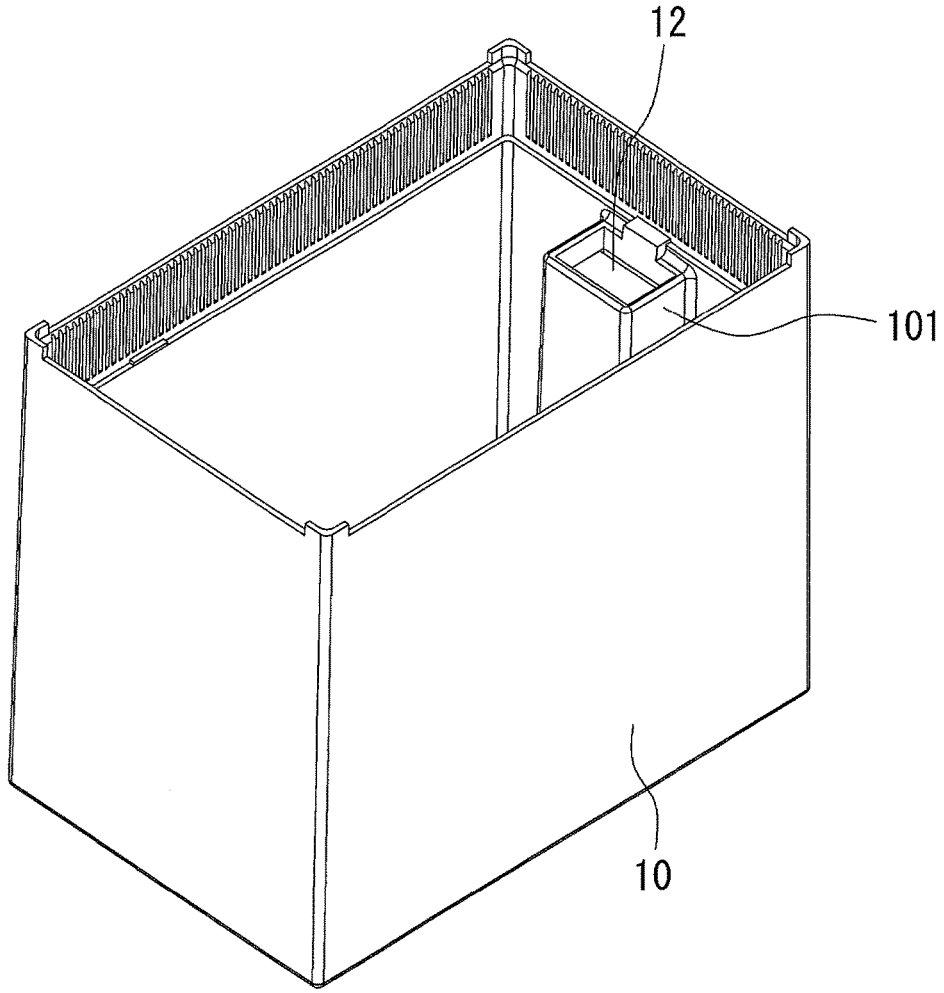
FIG. 3A illustrates an internal structure of a case 10.

As illustrated in FIG. 3A, in the case 10, a magnet holder 101 is formed. The permanent magnet 12 is supported in the magnet holder 101. The permanent magnet 12 supported in the magnet holder 101 is located between the fixed contact terminals 22*a* and 22*b* as illustrated in FIG. 2. The case 10 is omitted in FIG. 2. For example, a face of the permanent magnet 12 acting as a north polar is directed toward the fixed contact terminal 22*b* side. And another face of the permanent magnet 12 acting as a south polar is directed toward the fixed contact terminal 22*a* side. The face acting as the north polar and the face acting as the south polar may be reversed. The permanent magnet 12 may be a samarium-cobalt magnet that is excellent at a residual magnetic flux density, a holding power and a heat resistance property. In particular, a heat of an arc is conducted to the permanent magnet 12. Therefore, the samarium-cobalt magnet that has superior heat resistance property to a neodymium magnet is used.

With reference to FIG. 1 again, the hinge spring 14 is formed in a reverse L-shape if viewed from a side face. The hinge spring 14 has a horizontal portion 14*a* that biases a hanging portion 16*b* of the armature 16 downward and a hanging portion 14*b* that is fixed to a vertical portion 34*b* of the yoke 34.

Figure 3B:
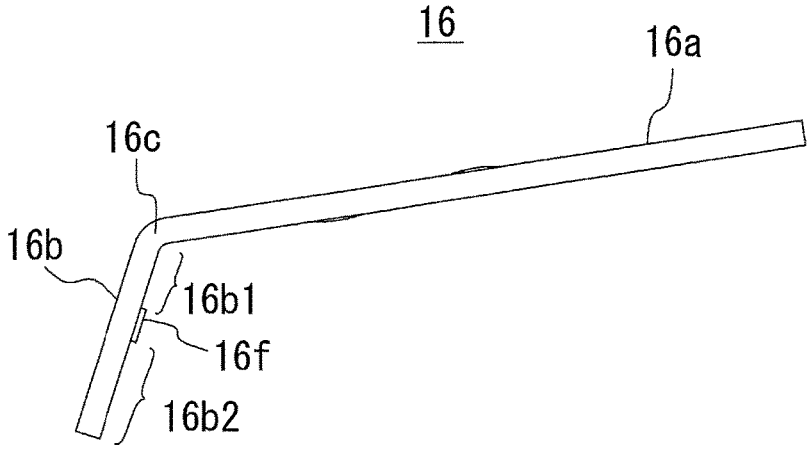
FIG. 3B illustrates a side view of an armature 16.

As illustrated in FIG. 3B, the armature 16 is a magnetic substance having a V shape if viewed from a side face. The armature 16 has a flat plate 16*a* adsorbed to the iron core 24 and the board-shaped hanging portion 16*b* that extends downward from the flat plate 16*a* via a bent portion 16*c*. On the hanging portion 16*b*, a projection 16*f* for fixing the movable contact spring 18 to the hanging portion 16*b* by caulking is provided on a first face of the hanging portion 16*b* that faces the insulating cover 20 or an electromagnetic device 31 described later. The hanging portion 16*b* has an upper portion 16*b*1 that extends from the bent portion 16*c* to the projection 16*f* and a lower portion 16*b*2 that extends downward from the projection 16*f*. As described later, the lower portion 16*b*2 acts as a pulling portion that pulls the movable contact spring 18. Moreover, as illustrated in FIG. 1 and FIG. 2, a through hole 16*d* is formed in a center of the bent portion 16*c* such that the horizontal portion 14*a* of the hinge spring 14 projects. In the flat plate 16*a*, a cutout portion 16*e* with which a projection 34*c* of the yoke 34 is engaged is formed.

The armature 16 rotates under a condition that the cutout portion 16*e* engaged in the projection 34*c* of the yoke 34 acts as a supporting point. When a current flows in the coil 30, the iron core 24 adsorbs the flat plate 16*a*. In this case, the horizontal portion 14*a* of the hinge spring 14 is in touch with the hanging portion 16*b* and is pressed from the hanging portion 16*b* upward. When the current of the coil 30 is shut off, the hanging portion 16*b* is pressed downward by a restoring force of the horizontal portion 14*a* of the hinge spring 14. Thus, the flat plate 16*a* is separated from the iron core 24. Here, a face of the flat plate 16*a* facing the iron core 24 or the insulating cover 20 is referred to as a first face. A face of the flat plate 16*a* opposite to the first face is referred to as a second face. A face of the hanging portion 16*b* facing the insulating cover 20 or the electromagnetic device 31 is referred to as a first face. And a face of the hanging portion 16*b* opposite to the first face is referred to as a second face.

Figure 4A:
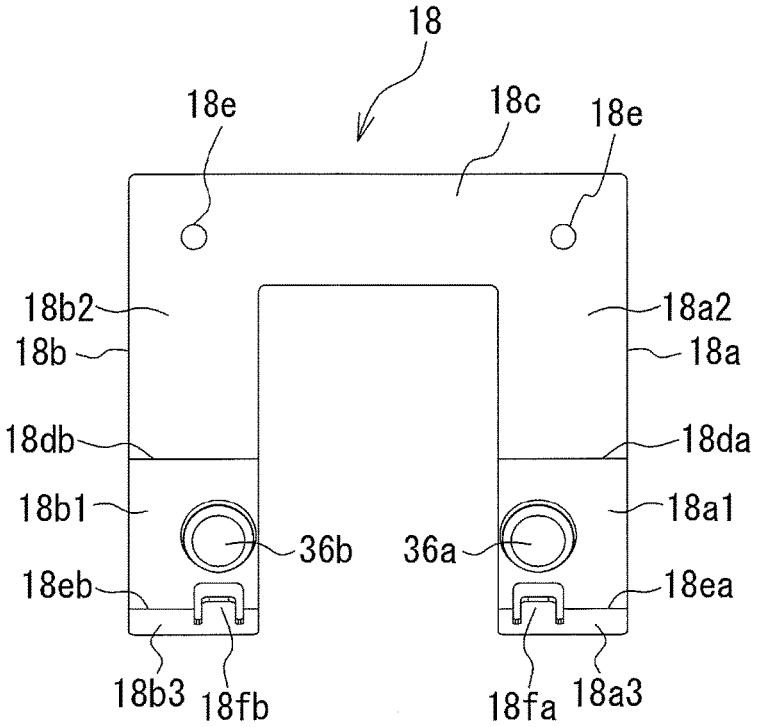
FIG. 4A illustrates a front view of a movable contact spring 18.
Figure 4B:
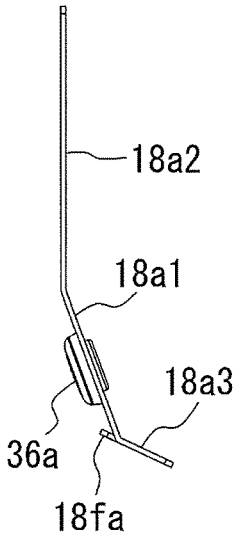
FIG. 4B illustrates a side view of a movable contact spring 18.

FIG. 4A illustrates a front view of the movable contact spring 18. FIG. 4B illustrates a side view of the movable contact spring 18.

As illustrated in FIG. 4A, the movable contact spring 18 is a conductive plate spring having a lateral U shape if viewed from a front, and has a pair of movable pieces (a first movable piece 18*a* and a second movable piece 18*b*) and a coupler 18*c* coupling upper edges of the first movable piece 18*a* and the second movable piece 18*b* in a horizontal direction.

The first movable piece 18*a* is bent twice at a position 18*da* closer to a lower edge than a center thereof and at a position 18*ea* closer to the lower edge than the position 18*da*. The second movable piece 18*b* is bent twice at a position 18*db* closer to the lower edge than the center and at a position 18*eb* closer to the lower edge than the position 18*db*. Here, a portion of the first movable piece 18*a* that is lower than the position 18*ea* is a lower portion 18*a*3. A portion of the first movable piece 18*a* between the position 18*ea* and the position 18*da* is a center portion 18*a*1. A portion of the first movable piece 18*a* that is upper than the position 18*da* is an upper portion 18*a*2. Similarly, a portion of the second movable piece 18*b* that is lower than the position 18*eb* is a lower portion 18*b*3. A portion of the second movable piece 18*b* between the position 18*eb* and the position 18*db* is a center portion 18*b*1. A portion of the second movable piece 18*b* that is upper than the position 18*db* is an upper portion 18*b*2.

A movable contact 36*a* made of a material with an excellent arc resistance is provided in the center portion 18*a*1 of the first movable piece 18*a*. A movable contact 36*b* made of a material with an excellent arc resistance is provided in the center portion 18*b*1 of the second movable piece 18*b*. The first movable piece 18*a* and the second movable piece 18*b* are bent in a direction where the upper portion 18*a*2 and the lower portion 18*a*3 of the first movable piece 18*a* and the upper portion 18*b*2 and the lower portion 18*b*3 of the second movable piece 18*b* are bent in a direction getting away from the fixed contact terminals 22*a* and 22*b*.

The upper portion 18*a*2 and the upper portion 18*b*2 act as an arc runner that moves an arc generated between contacts to au upper space. The lower portions 18*a*3 and 18*b*3 act as an arc runner that moves an arc generated between contacts to a lower space.

The coupler 18*c* has a through hole 18*e* with which the projection 16*f* provided on the hanging portion 16*b* is engaged. When the projection 16*f* is engaged and caulked in the through hole 18*e*, the movable contact spring 18 is fixed to the first face of the hanging portion 16*b* of the armature 16.

The first movable piece 18*a* has a cut projection portion 18*fa* that projects toward the movable contact 36*a* from the lower portion 18*a*3 along a face of the lower portion 18*a*3 and is inclined with respect to the center portion 18*a*1. Moreover, the second movable piece 18*b* has a cut projection portion 18*fb* that projects toward the movable contact 36*b* from the lower portion 18*b*3 along a face of the lower portion 18*b*3 and is inclined with respect to the center portion 18*b*1. The cut projection portions 18*fa* and 18*fb* connected to the lower portions 18*a*3 and 18*b*3 reduce a distance between the movable contact 36*a* and the lower portion 18*a*3 (other than a contact) and a distance between the movable contact 36*b* and the lower portion 18*b*3. Therefore, an arc generated between the movable contact 36*a* and a fixed contact 38*a* and an arc generated between the movable contact 36*b* and a fixed contact 38*b* can quickly move to the lower portions 18*a*3 and 18*b*3 (other than a contact) respectively from a contact thereof. Therefore, the cut projection portions 18*fa* and 18*fb* can suppress exhausting of the contacts.

Figure 5A:
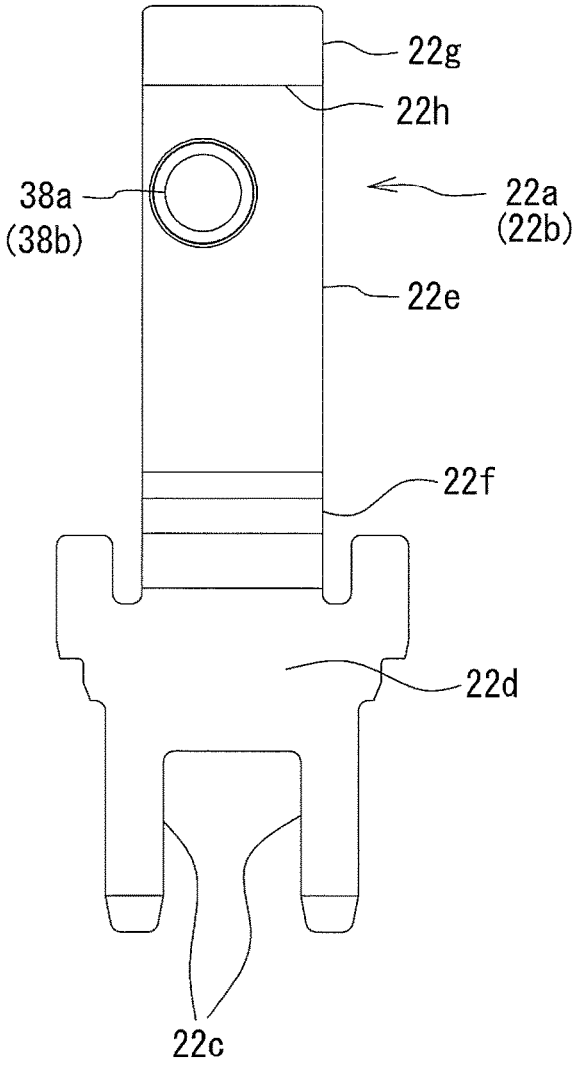
FIG. 5A illustrates a front view of fixed contact terminals 22*a* and 22*b;*
Figure 5B:
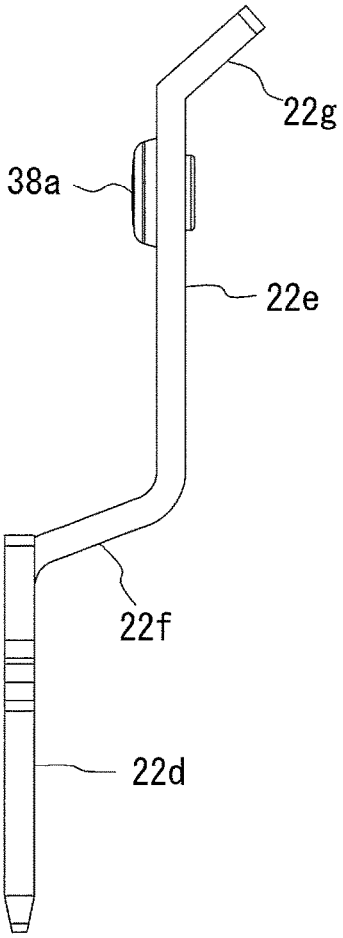
FIG. 5B illustrates a side view of fixed contact terminals 22*a* and 22*b;*

FIG. 5A illustrates a front view of the fixed contact terminals 22*a* and 22*b*. FIG. 5B illustrates a side view of the fixed contact terminals 22*a* and 22*b*.

The fixed contact terminals 22*a* and 22*b* are injected from above into the through hole (not illustrated) formed in the base 28 and are fixed to the base 28. The fixed contact terminals 22*a* and 22*b* are bent in a clank shape if viewed from a side face. The fixed contact terminals 22*a* and 22*b* respectively have an uppermost portion 22*g*, an upper portion 22*e*, an inclination portion 22*f* and a lower portion 22*d*. The lower portion 22*d* where the fixed contact terminals 22*a* and 22*b* are fixed to the base 28 acts as a supporting point. The upper portion 22*e* is bent so as to get away more from the movable contact spring 18 or the insulating cover 20 than the lower portion 22*d*. The fixed contacts 38*a* and 38*b* made of a material with an excellent arc resistance are respectively provided on the upper portions 22*e* of the fixed contact terminals 22*a* and 22*b*. A divided terminal 22*c* connected to a power supply or the like is provided on the lower portions 22*d* of the fixed contact terminals 22*a* and 22*b*.

The uppermost portion 22*g* is formed by bending the fixed contact terminals 22*a* and 22*b* at a position 22*h* that is upper than the fixed contacts 38*a* and 38*b*. In FIG. 5A and FIG. 5B, a portion upper than the position 22*h* is the uppermost portion 22*g*. A portion between the position 22*h* and the inclination portion 22*f* is the upper portion 22*e*.

The uppermost portion 22*g* is bent so as to get away from the movable contact spring 18 or the insulating cover 20 more than the upper portion 22*e*. The uppermost portion 22*g* acts as an arc runner that moves the arc generated between contacts to an upper space from the movable contacts 36*a* and 36*b* and the fixed contacts 38*a* and 38*b*.

With reference to FIG. 1 again, the insulating cover 20 is made of resin. A ceiling portion 20*e* of the insulating cover 20 has a through hole 20*a* that exposes a head portion 24*a* of the iron core 24. Fixed portions 20*b* and 20*c* having a projection shape are formed on the bottom of the insulating cover 20 to fix the insulating cover 20 to the base 28. The fixed portion 20*b* is engaged with an edge of the base 28. The fixed portion 20*c* is inserted into a hole of the base 28 that is not illustrated. A backstop 20*d* made of a resin is formed integrally with the insulating cover 20. When no current flows into the coil 30 (that is, the electromagnetic device 31 described later is off), the backstop 20*d* acting as a stopper is in touch with the movable contact spring 18. The backstop 20*d* suppresses generation of collision sound between metal components such as the movable contact spring 18 and the yoke 34. It is therefore possible to reduce an operation sound of the relay 1.

The iron core 24 is inserted into a through hole 26*a* formed in a head portion 26*b* of the spool 26. The coil 30 is wound around the spool 26 and is formed integrally with the base 28. The iron core 24, the spool 26 and the coil 30 form the electromagnetic device 31. The electromagnetic device 31 pulls the flat plate 16*a* of the armature 16 or cancels the pulling in accordance with on/off of a current. Thus, opening or closing operation of the movable contact spring 18 with respect to the fixed contact terminals 22*a* and 22*b* is performed. The pair of the coil terminals 32*a* and 32*b* is pressed into the base 28. The coil 30 is lumped on the pair of coil terminals 32*a* and 32*b*.

The yoke 34 is made of a conductive material having an L shape if viewed from a side face and has a horizontal portion 34*a* fixed to a reverse face of the base 28 and a vertical portion 34*b* provided vertically to the horizontal portion 34*a*. From the bottom of the base 28, the vertical portion 34*b* is pressed into a through hole of the base 28 that is not illustrated and is pressed into a through hole of the insulating cover 20 that is not illustrated. Thus, as illustrated in FIG. 2, the projection 34*c* provided on both edges of the upper portion of the vertical portion 34*b* projects from the ceiling portion 20*e* of the insulating cover 20.

Figure 6A:
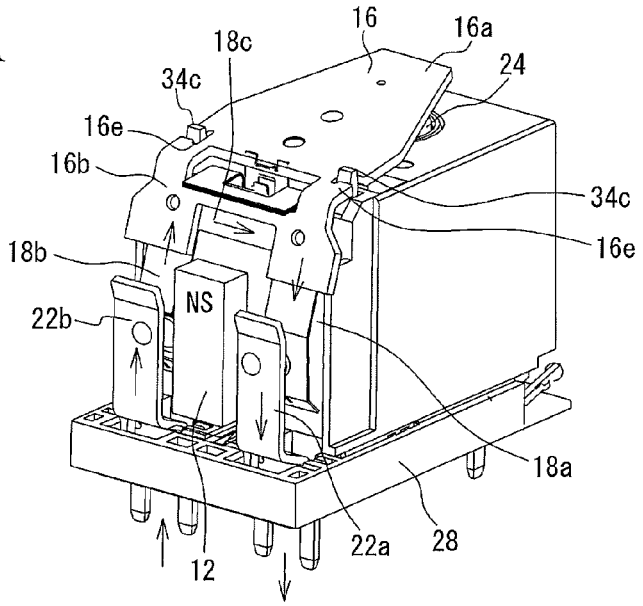
FIG. 6A schematically illustrates a direction of a current flowing in a relay.
Figure 6B:
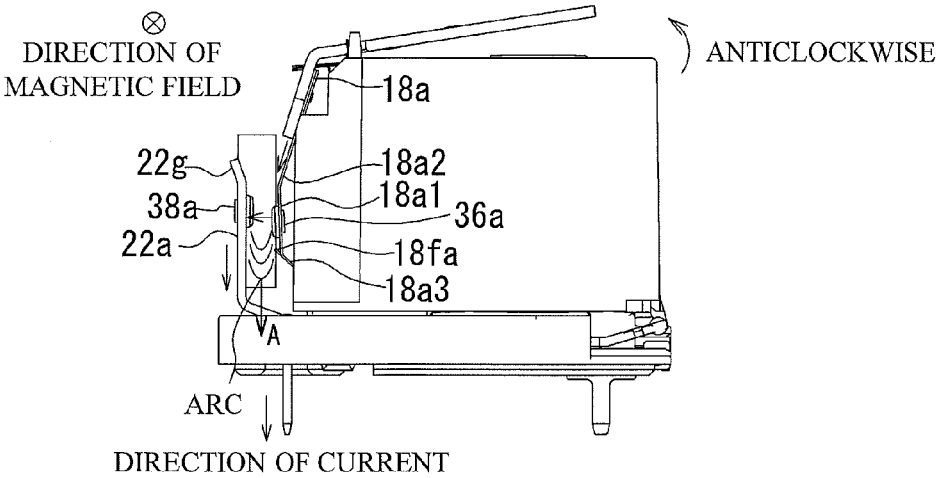
FIG. 6B illustrates an arc extinction viewed from a fixed contact terminal 22*a* side.
Figure 6C:
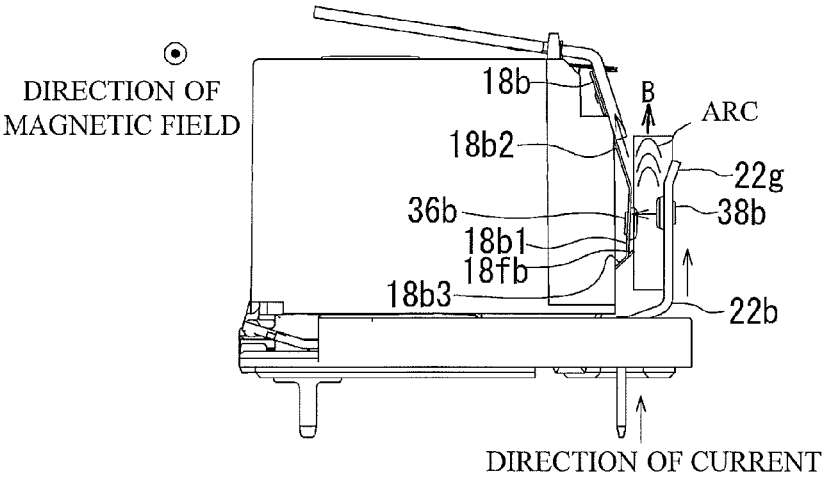
FIG. 6C illustrates an arc extinction viewed from a fixed contact terminal 22*b* side.

FIG. 6A schematically illustrates the direction of the current flowing in the relay 1 and, in particular, illustrates the condition where the fixed contact is off the movable contact. FIG. 6B illustrates an arc extinction viewed from the fixed contact terminal 22*a* side. FIG. 6C illustrates the arc extinction viewed from the fixed contact terminal 22*b* side. In FIG. 6A to FIG. 6C, the direction of the current (first direction) is illustrated with an arrow.

In FIG. 6A, at least one of the fixed contact terminals 22*a* and 22*b* is connected to a power supply side that is not illustrated. The other is connected to a load side that is not illustrated. When a current flows in the coil 30, the iron core 24 adsorbs the flat plate 16*a* and the armature 16 rotates under a condition that the projection 34*c* and the cutout portion 16*e* act as a supporting point. With the rotation of the armature 16, the hanging portion 16*b* and the movable contact spring 18 fixed to the hanging portion 16*b* rotate. And, the movable contacts 36*a* and 36*b* are in touch with the corresponding fixed contacts 38*a* and 38*b*. When a voltage is applied to the fixed contact terminal 22*b* under a condition that the movable contacts 36*a* and 36*b* are in touch with the fixed contacts 38*a* and 38*b*, the current flows in the fixed contact terminal 22*b*, the fixed contact 38*b*, the movable contact 36*b*, the second movable piece 18*b*, the coupler 18*c*, the first movable piece 18*a*, the movable contact 36*a*, the fixed contact 38*a* and the fixed contact terminal 22*a* in this order as illustrated in FIG. 6A. When the current flowing in the coil 30 is shut off, the restoring force of the hinge spring 14 rotates the armature 16 anticlockwise illustrated in FIG. 6B. Because of the rotation of the armature 16, the movable contacts 36*a* and 36*b* start to get away from the fixed contacts 38*a* and 38*b* respectively. However, the current flowing between the movable contact 36*a* and the fixed contact 38*a* and the current flowing between the movable contact 36*b* and the fixed contact 38*b* are not completely shut off. Thereby, an arc is generated between the fixed contacts 38*a* and 38*b* and the movable contacts 36*a* and 36*b*.

In the relay 1 illustrated in FIG. 6A to FIG. 6C, as illustrated in FIG. 6B, the direction of the magnetic field is a depth direction from the fixed contact terminal 22*a* to the fixed contact terminal 22*b* in a place where the current flows from the movable contact 36*a* to the fixed contact 38*a*. Therefore, an arc generated between the movable contact 36*a* and the fixed contact 38*a* is extended to a lower space by Lorentz force as indicated by an arrow A of FIG. 6B and is extinguished. On the other hand, in a place where the current flows from the fixed contact 38*b* to the movable contact 36*b*, as illustrated in FIG. 6C, the direction of the magnetic field is a depth direction from the fixed contact terminal 22*a* to the fixed contact terminal 22*b*. Therefore, an arc generated between the movable contact 36*b* and the fixed contact 38*b* is extended to an upper space by the Lorentz force as indicated by an arrow B of FIG. 6C and is extinguished.

Figure 7A:
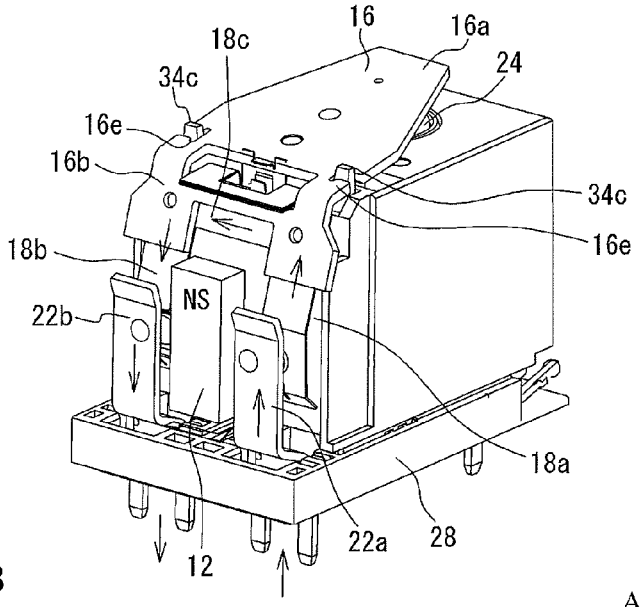
FIG. 7A schematically illustrates a direction of a current flowing in a relay.
Figure 7B:
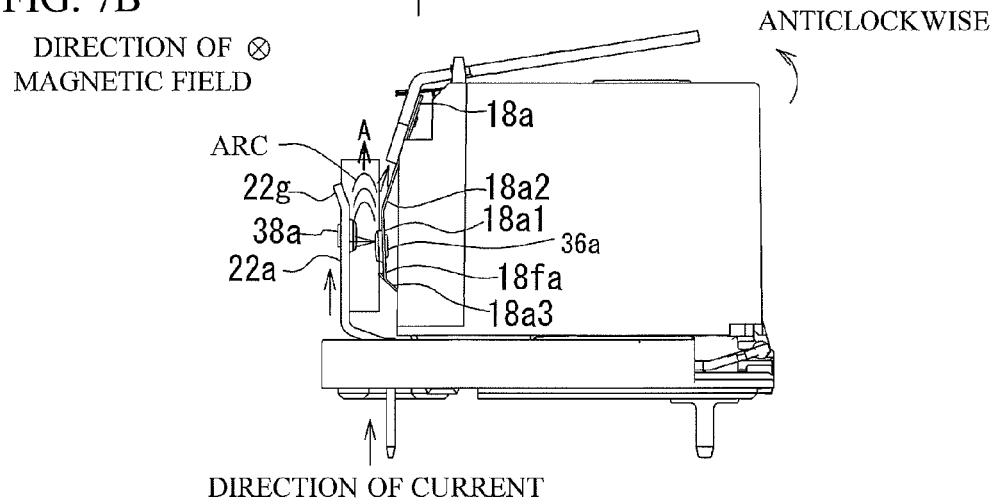
FIG. 7B illustrates an arc extinction viewed from a fixed contact terminal 22*a* side.
Figure 7C:
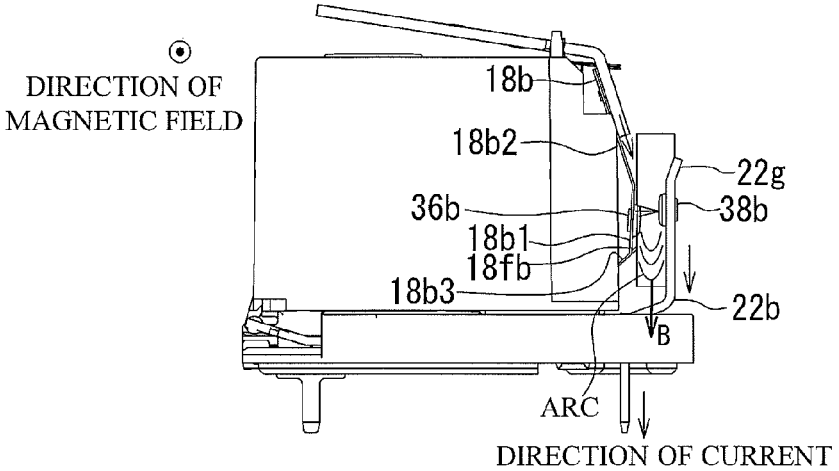
FIG. 7C illustrates an arc extinction viewed from a fixed contact terminal 22*b* side.

FIG. 7A schematically illustrates the direction of the current flowing in the relay 1. FIG. 7B illustrates an arc extinction viewed from the fixed contact terminal 22*a* side. FIG. 7C illustrates the arc extinction viewed from the fixed contact terminal 22*b* side. In FIG. 7A to FIG. 7C, the direction of the current (a second direction) is indicated with an arrow. The direction of the current is opposite to that of FIG. 6A to FIG. 6C.

In FIG. 7A, as in the case of FIG. 6A, one of the fixed contact terminals 22*a* and 22*b* is connected to a power supply side that is not illustrated. The other is connected to a load side that is not illustrated. When a current flows in the coil 30, the iron core 24 adsorbs the flat plate 16*a* and the armature 16 rotates under a condition that the projection 34*c* and the cutout portion 16*e* act as a supporting point. With the rotation of the armature 16, the hanging portion 16*b* and the movable contact spring 18 fixed to the hanging portion 16*b* rotate. And, the movable contacts 36*a* and 36*b* are in touch with the corresponding fixed contacts 38*a* and 38*b*. When a voltage is applied to the fixed contact terminal 22*a* under a condition that the movable contacts 36*a* and 36*b* are in touch with the fixed contacts 38*a* and 38*b*, the current flows in the fixed contact terminal 22*a*, the fixed contact 38*a*, the movable contact 36*a*, the first movable piece 18*a*, the coupler 18*c*, the second movable piece 18*b*, the movable contact 36*b*, the fixed contact 38*b* and the fixed contact terminal 22*b* in this order as illustrated in FIG. 7A. When the current flowing in the coil 30 is shut off, the restoring force of the hinge spring 14 rotates the armature 16 anticlockwise illustrated in FIG. 7B. Because of the rotation of the armature 16, the movable contacts 36*a* and 36*b* start to get away from the fixed contacts 38*a* and 38*b* respectively. However, the current flowing between the movable contact 36*a* and the fixed contact 38*a* and the current flowing between the movable contact 36*b* and the fixed contact 38*b* are not completely shut off. Thereby, an arc is generated between the fixed contacts 38*a* and 38*b* and the movable contacts 36*a* and 36*b*.

In the relay 1 illustrated in FIG. 7A to FIG. 7C, as illustrated in FIG. 7B, the direction of the magnetic field is a depth direction from the fixed contact terminal 22*a* to the fixed contact terminal 22*b* in a place where the current flows from the fixed contact 38*a* to the movable contact 36*a*. Therefore, an arc generated between the movable contact 36*a* and the fixed contact 38*a* is extended to an upper space by Lorentz force as indicated by an arrow A of FIG. 7B and is extinguished. On the other hand, in a place where the current flows from the movable contact 36*b* to the fixed contact 38*b*, as illustrated in FIG. 7C, the direction of the magnetic field is a depth direction from the fixed contact terminal 22*a* to the fixed contact terminal 22*b*. Therefore, an arc generated between the movable contact 36*b* and the fixed contact 38*b* is extended to a lower space by the Lorentz force as indicated with an arrow B of FIG. 7C and is extinguished.

In FIG. 6A to FIG. 7C, the relay 1 of the embodiment can simultaneously extend the arc generated between the movable contact 36*a* and the fixed contact 38*a* and the arc generated between the movable contact 36*b* and the fixed contact 38*b* in the reverse direction spaces and extinguish the arcs despite the directions of the current flowing between the movable contact 36*a* and the fixed contact 38*a* and the current flowing between the movable contact 36*b* and the fixed contact 38*b*.

A supporting point of a movable member including the armature 16 and the movable contact spring 18 (for example, the cutout portion 16*e*) is located on the upper side of the movable contacts 36*a* and 36*b* or the fixed contacts 38*a* and 38*b*. A supporting point of the fixed contact terminals 22*a* and 22*b* (for example, the lower portion 22*d*) is located on the lower side of the movable contacts 36*a* and 36*b* or the fixed contacts 38*a* and 38*b*. Therefore, even if the arc generated between the movable contact 36*a* and the fixed contact 38*a* is extended toward an upper direction or a lower direction in accordance with the direction of the current flowing between the movable contact 36*a* and the fixed contact 38*a*, it is possible to secure the space for extending the arc. Similarly, even if the arc generated between the movable contact 36*b* and the fixed contact 38*b* is extended toward an upper direction or a lower direction in accordance with the direction of the current flowing between the movable contact 36*b* and the fixed contact 38*b*, it is possible to secure the space for extending the arc.

Figure 8A:
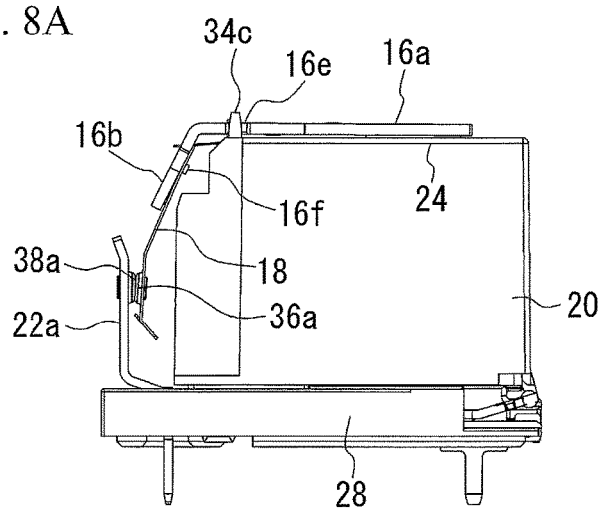
FIG. 8A illustrates a side view of a relay 1 viewed from a first movable piece 18*a* side.
Figure 8B:
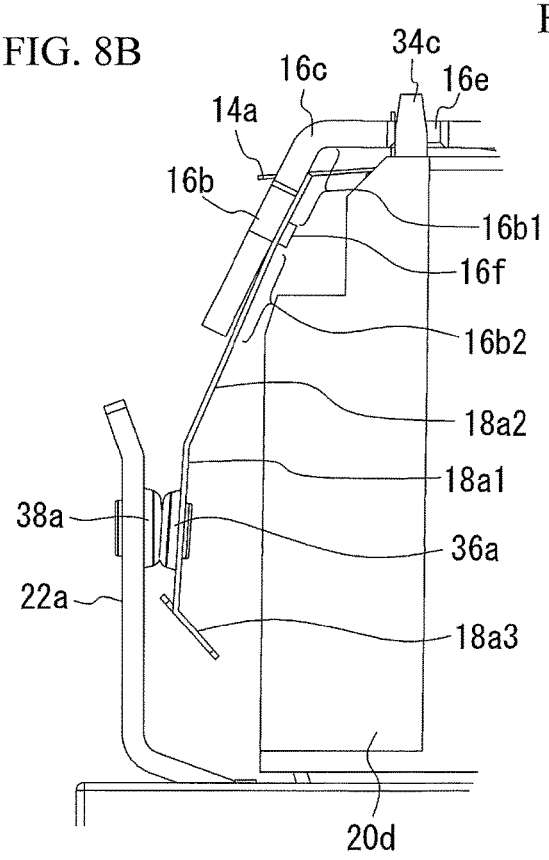
FIG. 8B illustrates an enlarged view of a fixed contact terminal 22*a*, a movable contact spring 18 and an armature 16.
Figure 8C:
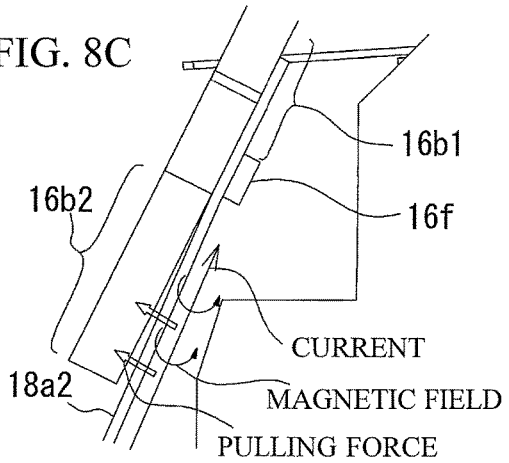
FIG. 8C and FIG. 8D illustrate a partially enlarged view of a movable contact spring 18 and an armature 16.
Figure 8D:
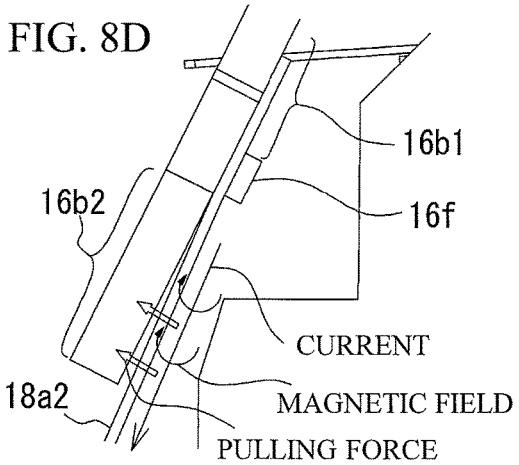

FIG. 8A illustrates a side view of the relay 1 viewed from the first movable piece 18*a* side. FIG. 8B illustrates an enlarged view of the fixed contact terminal 22*a*, the movable contact spring 18 and the armature 16. FIG. 8C and FIG. 8D illustrate a partially enlarged view of the movable contact spring 18 and the armature 16.

When a current flows in the coil 30, the iron core 24 adsorbs the flat plate 16*a* and the armature 16 rotates under a condition that the projection 34*c* and the cutout portion 16*e* act as a supporting point. Because of the rotation of the armature 16, the hanging portion 16*b* and the movable contact spring 18 fixed to the hanging portion 16*b* rotate. And as illustrated in FIG. 8A, the movable contact 36*a* is in touch with the fixed contact 38*a*.

In this case, the movable contact spring 18 is fixed with caulking by the projection 16*f* provided on the first face of the hanging portion 16*b*. Therefore, as illustrated in FIG. 8B, the upper portion 18*a*2 of the first movable piece 18*a* facing the lower portion 16*b*2 of the hanging portion 16*b* of the armature 16 (in concrete, the upper portion 18*a*2 positioned lower than the projection 16*f*) is warped and is spaced from the hanging portion 16*b* of the armature 16. That is, a clearance "A" is formed between the lower portion 16*b*2 of the hanging portion 16*b* of the armature 16 and the upper portion 18*a*2 of the first movable piece 18*a*.

When the movable contact 36*a* is in touch with the fixed contact 38*a*, the current flows to the upper portion 18*a*2 of the first movable piece 18*a* as illustrated in FIG. 8C, for example. Therefore, a magnetic field is generated in the upper portion 18*a*2 by a right-handed screw rule. The armature 16 is a magnetic substance. A magnetic field toward the upper portion 18*a*2 is generated in the armature 16. Accordingly, as illustrated in FIG. 8C, a pulling force is generated in the upper portion 18*a*2 of the first movable piece 18*a* toward the lower portion 16*b*2 of the hanging portion 16*b*.

As illustrated in FIG. 8D, when the direction of the current is opposite to FIG. 8C, the direction of the magnetic field is also opposite to FIG. 8C. However, as in the case of FIG. 8C, a pulling force is generated in the upper portion 18*a*2 of the first movable piece 18*a* toward the lower portion 16*b*2 of the hanging portion 16*b*.

Therefore, despite the direction of the current flowing into the first movable piece 18*a*, a pulling force is generated in the upper portion 18*a*2 of the first movable piece 18*a* toward the lower portion 16*b*2 of the hanging portion 16*b*. The pulling force presses the movable contact 36*a* to the fixed contact 38*a*. It is therefore possible to suppress getting away of the movable contact 36*a* from the fixed contact 38*a* when an electromagnetic repulsion force is generated, getting away of the movable contact 36*a* from the fixed contact 38*a* can be suppressed.

The hanging portion 16*b* of the armature 16 faces the upper portion 18*a*2 of the first movable piece 18*a* and has the lower portion 16*b*2 extending downward more than the projection 16*f*. Therefore, even if a new component for generating a pulling force between the movable contact and the fixed contact is not provided, the lower portion 16*b*2 can pull the upper portion 18*a*2 of the first movable piece 18*a*. Therefore, even if an electromagnetic repulsion force is generated during energization of an overcurrent, getting away of the lower portion 16*b*2 of the hanging portion 16*b* of the armature 16 and the movable contact 36*a* from the fixed contact 38*a* can be suppressed.

Here, a description is given of the first movable piece 18*a*. However, the upper portion 18*b*2 of the second movable piece 18*b* also generates a pulling force, similarly to the upper portion 18*a*2 of the first movable piece 18*a*. Therefore, the lower portion 16*b*2 of the hanging portion 16*b* can pull the upper portion 18*b*2 of the second movable piece 18*b*.

As mentioned above, in the first embodiment, the movable contact spring 18 has the pair of the movable pieces 18*a* and 18*b* that are connected to the fixed contacts 38*a* and 38*b* or are separated from the fixed contacts 38*a* and 38*b* and has the coupler 18*c* that couples the pair of the movable pieces 18*a* and 18*b*. And, the hanging portion 16*b* of the armature 16 has the projection 16*f* for fixed the movable contact spring 18 with caulking on the first face facing the electromagnetic device 31 and the lower portion 16*b*2 that extends downward more than the projection 16*f* and pulls the movable contact spring 18 when the current flows between the fixed contacts 38*a* and 38*b* and the movable contacts 36*a* and 36*b*. Therefore, in the relay 1 of the embodiment, the current that is input from one fixed contact is output to the other fixed contact via the movable contact spring 18 having a lateral C shape if viewed from a front, that is, a current path having a lateral C shape. Therefore, it is not necessary to provide current paths around a fixed contact and a movable contact. And, it is possible to downsize the relay. And the hanging portion 16*b* can pull the movable contact spring 18 (that is, the upper portions 18*a*2 and 18*b*2). It is not necessary to provide a new component for generating a pulling force between the movable contact and the fixed contact. Therefore, a manufacturing cost can be reduced.

Figure 9:
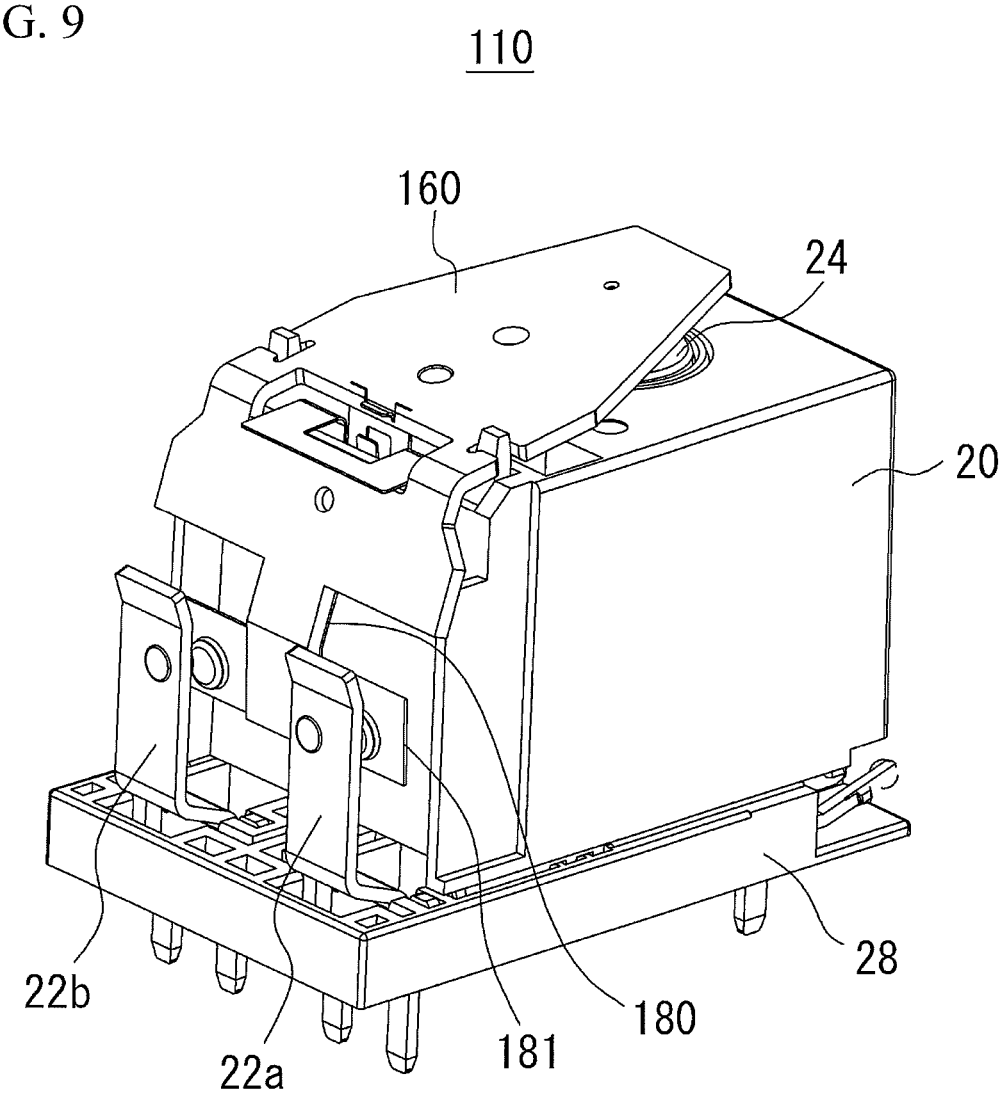
FIG. 9 illustrates a perspective view of a relay 110 in accordance with a second embodiment.

FIG. 9 illustrates a perspective view of a relay 110 in accordance with a second embodiment. The relay 110 of the second embodiment has an armature 160, a plate spring 180 and a connection plate 181. Other structures of the relay 110 of the second embodiment are the same as the corresponding structure of the first embodiment. Therefore, an explanation of the structures is omitted.

Figure 10A:
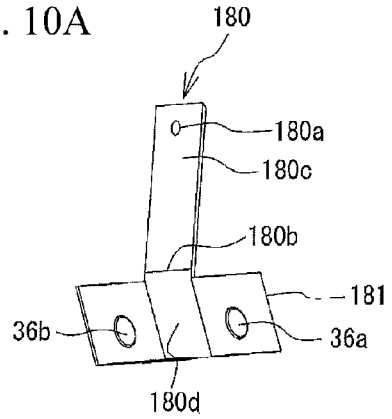
FIG. 10A illustrates a structure diagram of a plate spring 180 and a connection plate 181.
Figure 10B:
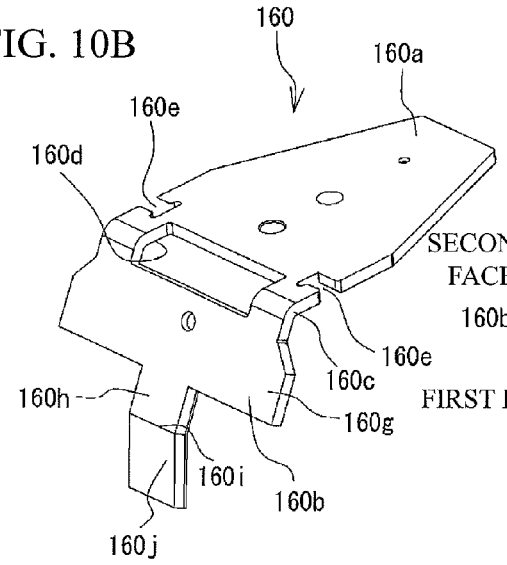
FIG. 10B illustrates a structure diagram of an armature 160.
Figure 10C:
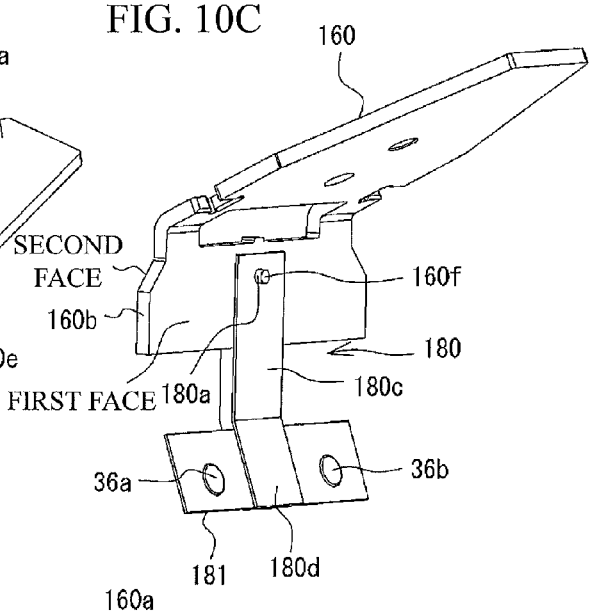
FIG. 10C illustrates a condition where a plate spring 180 and a connection plate 181 are attached to an armature 160.
Figure 10D:
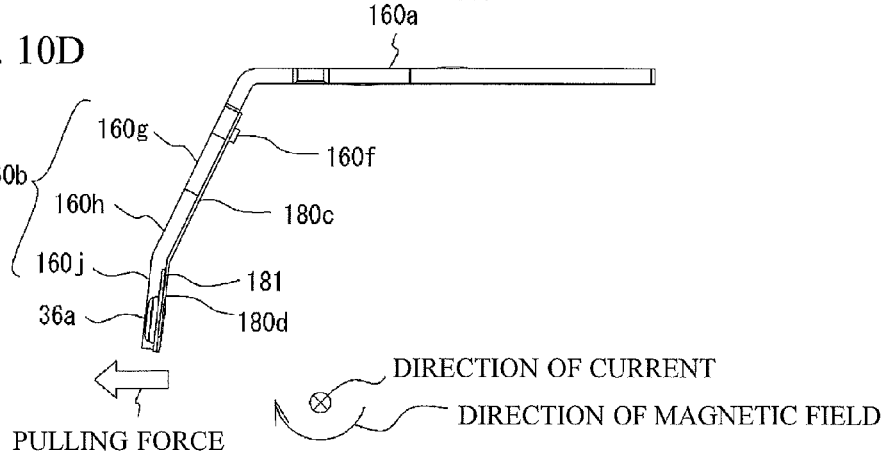
FIG. 10D illustrates a side view of a plate spring 180, a connection plate 181 and an armature 160.

FIG. 10A illustrates a structure diagram of the plate spring 180 and the connection plate 181. FIG. 10B illustrates a structure diagram of the armature 160. FIG. 10C illustrates a condition where the plate spring 180 and the connection plate 181 are attached to the armature 160. FIG. 10D illustrates a side view of the plate spring 180, the connection plate 181 and the armature 160.

As illustrated in FIG. 10A, the plate spring 180 is a plate spring that is conductive and has a V shape if viewed from a side face. The plate spring 180 is bent at a position 180*b* that is closer to a bottom than a center thereof. Here, a portion of the plate spring 180 that is upper than the position 180*b* is an upper portion 180*c*. A portion of the plate spring 180 that is lower than the position 180*b* is a lower portion 180*d*. The upper portion 180*c* has a through hole 180*a* that is engaged with a projection 160*f* formed on a hanging portion 160*b* of the armature 160. As illustrated in FIG. 10C, when the projection 160*f* is engaged with the through hole 180*a* with caulking, the plate spring 180 is fixed to the first face of the hanging portion 160*b* of the armature 160. Here, a face of the hanging portion 160*b* facing the electromagnetic device 31 or the insulating cover 20 is the first face. A reverse face of the first face is a second face. The plate spring 180 is bent in a direction where the upper portion 180*c* gets away from the fixed contact terminals 22*a* and 22*b* (that is, the direction in which plate spring 180 gets closer to the electromagnetic device 31).

The connection plate 181 is a conductive plate and is horizontally fixed to the lower portion 180*d*. The movable contacts 36*a* and 36*b* made of a material with an excellent arc resistance are respectively provided on the both right and left edges of the connection plate 181.

A first edge of the plate spring 180 is fixed with caulking to the first face of the hanging portion 160*b* of the armature 160. A second edge of the plate spring 180 is fixed to the connection plate 181 so as to extend vertically to the direction between the movable contacts 36*a* and 36*b* and is fixed between the movable contacts 36*a* and 36*b*.

As illustrated in FIG. 10B and FIG. 10D, the armature 160 is a magnetic substance that is bent twice. The armature 160 has a flat plate 160*a* adsorbed to the iron core 24 and the plate-shaped hanging portion 160*b* extending downward from the flat plate 160*a* via a bent portion 160*c*. Moreover, as illustrated in FIG. 10B, a through hole 160*d* is formed in a center portion of the bent portion 160*c* such that the horizontal portion 14*a* of the hinge spring 14 projects. A cutout portion 160*e* with which the projection 34*c* of the yoke 34 is engaged is formed in the flat plate 160*a*. The armature 160 rotates under a condition that the projection 34*c* of the yoke 34 and the cutout portion 160*e* act as a supporting point, as in the case of the above-mentioned armature 16. When a current flows in the coil 30, the iron core 24 adsorbs the flat plate 160*a*. In this case, the horizontal portion 14*a* of the hinge spring 14 is in touch with the hanging portion 160*b* and is pressed upward by the hanging portion 160*b*. When the current of the coil 30 is shut off, the restoring force of the horizontal portion 14*a* of the hinge spring 14 presses down the hanging portion 160*b*. Thus, the flat plate 160*a* is separated from the iron core 24.

As illustrated in FIG. 10C, in the hanging portion 160*b*, the projection 160*f* for fixing the plate spring 180 to the hanging portion 160*b* with caulking is provided on the first face of the hanging portion 160*b* facing the electromagnetic device 31 or the insulating cover 20. As illustrated in FIG. 10B, the hanging portion 160*b* is a magnetic substance having a substantially T shape if viewed from a front thereof. And the hanging portion 160*b* has an upper portion 160*g* connected to the bent portion 160*c*, a center portion 160*h* extending downward from a bottom center of the upper portion 160*g*, and a lower portion 160*j* extending downward from the center portion 160*h*. The lower portion 160*j* acts as a pulling portion for pulling the connection plate 181 and the plate spring 180. The hanging portion 160*b* is bent at a position 160*i* between the center portion 160*h* and the lower portion 160*j*. When the lower portion 160*j* is arranged substantially vertically, the upper portion 160*g* and the center portion 160*h* of the hanging portion 160*b* are bent in a direction getting away from the fixed contact terminals 22*a* and 22*b* (that is, a direction approaching the insulating cover 20). The hanging portion 160*b* extends so as to overlap with the plate spring 180 and the connection plate 181 as illustrated in FIG. 10D. Moreover, as illustrated in FIG. 10D, the hanging portion 160*b* is bent along a shape of the plate spring 180. That is, the hanging portion 160*b* is bent so as to overlap with the plate spring 180. Therefore, the upper portion 160*g* and the center portion 160*h* overlap with the upper portion 180*c*, and the lower portion 160*j* overlaps with the lower portion 180*d*.

When a current flows from the movable contact 36*a* to the movable contact 36*b* as illustrated in FIG. 10D under a condition that the movable contacts 36*a* and 36*b* are respectively in touch with the fixed contacts 38*a* and 38*b*, a magnetic field is generated in the connection plate 181 by a right-handed screw rule. The armature 160 is a magnetic substance. A magnetic field is generated toward the lower portion 160*j*. Therefore, in the connection plate 181, a pulling force is generated toward the lower portion 160*j* of the hanging portion 160*b*. When the direction of the current is opposite to FIG. 10D, the direction of the magnetic field is also opposite to FIG. 10D. However, a magnetic field toward the lower portion 160*j* is generated. Therefore, as in the case of FIG. 10D, in the connection plate 181, a pulling force is generated toward the lower portion 160*j* of the hanging portion 160*b*. Therefore, despite the direction of the current flowing into the connection plate 181, a pulling force is generated toward the lower portion 160*j* of the hanging portion 160*b* in the connection plate 181. When an electromagnetic repulsion force is generated, the pulling force can suppress getting away of the movable contacts 36*a* and 36*b* from the fixed contacts 38*a* and 38*b*.

The hanging portion 160*b* of the armature 160 faces the lower portion 180*d* of the plate spring 180 and has the center portion 160*h* and the lower portion 160*j* extending downward from the projection 160*f*. Therefore, even if a new component for generating a pulling force between the movable contact and the fixed contact is not provided, the lower portion 160*j* can pull the connection plate 181 and the lower portion 180*d* of the plate spring 180. Even if an electromagnetic repulsion force is generated during energization of an overcurrent, the lower portion 160*j* of the hanging portion 160*b* can suppress getting away of the movable contacts 36*a* and 36*b* from the fixed contacts 38*a* and 38*b*.

Figure 11A:
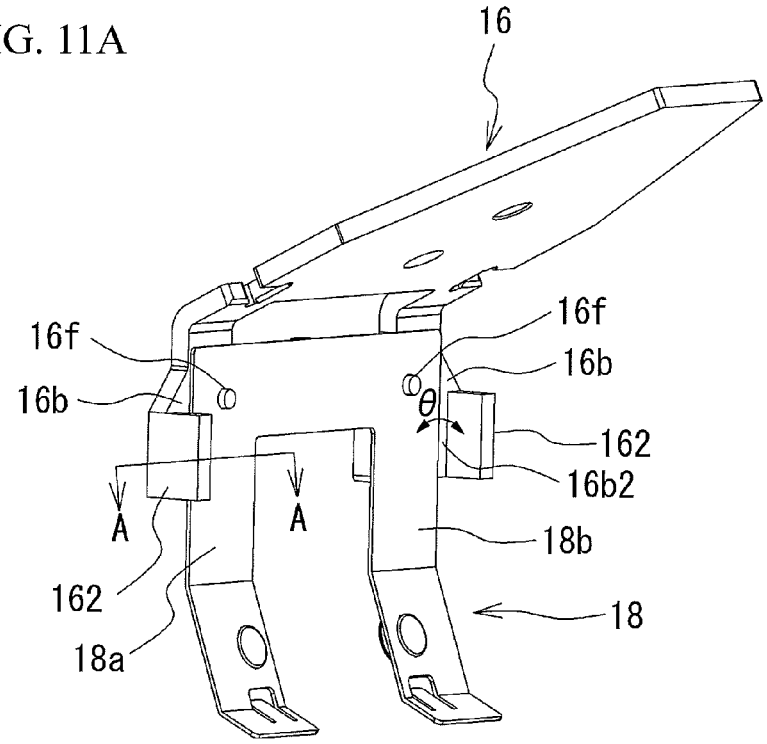
FIG. 11A illustrates a modified embodiment of an armature 16.
Figure 11B:
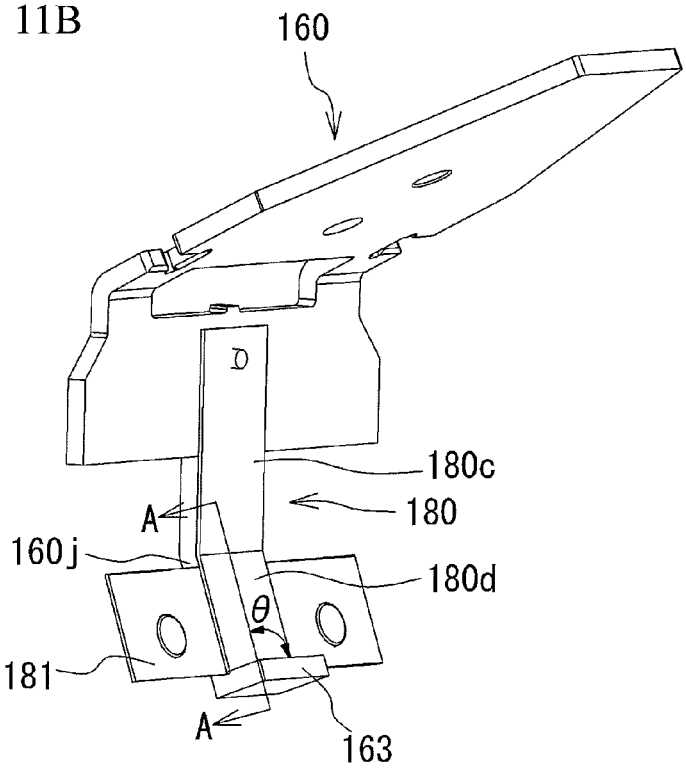
FIG. 11B illustrates a modified embodiment of an armature 160.
Figure 12A:
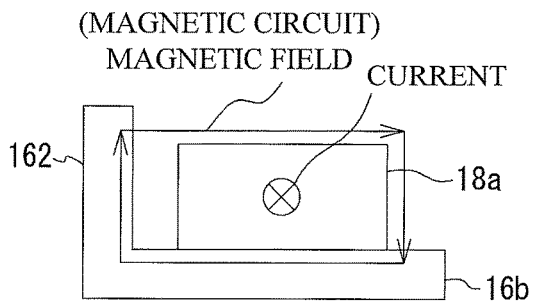
FIG. 12A illustrates a cross sectional view taken along a line A-A of FIG. 11A.
Figure 12B:
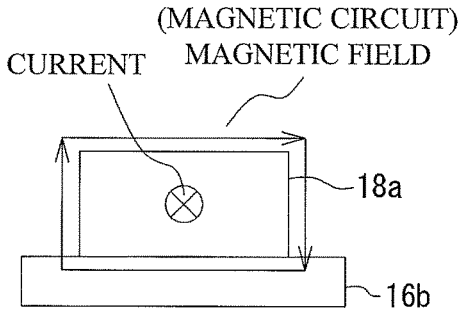
FIG. 12B illustrates a cross sectional view of an armature 16 and a movable contact spring 18 without a side wall.
Figure 12C:
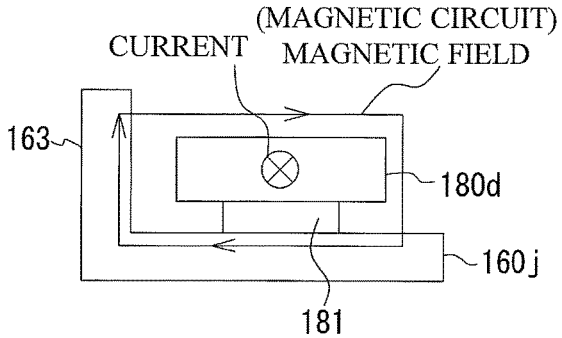
FIG. 12C illustrates a cross sectional view taken along a line A-A of FIG. 11B.
Figure 12D:
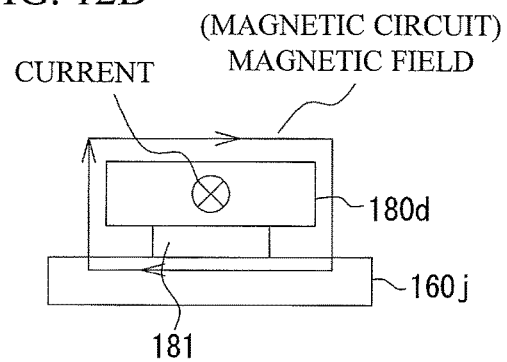
FIG. 12D illustrates a cross sectional view of an armature 160, a connection plate 181 and a plate spring 180 without a bottom wall.

FIG. 11A illustrates a modified embodiment of the armature 16. FIG. 11B illustrates a modified embodiment of the armature 160. FIG. 12A illustrates a cross sectional view taken along a line A-A of FIG. 11A. FIG. 12B illustrates a cross sectional view of the armature 16 and the movable contact spring 18 without a sidewall. FIG. 12C illustrates a cross sectional view taken along a line A-A of FIG. 11B. FIG. 12D illustrates a cross sectional view of the armature 160, the connection plate 181 and the plate spring 180 without a bottom wall. A direction of the current illustrated in FIG. 12A to FIG. 12D is an example and may be reversed. When the direction of the current is reversed, the direction of the magnetic field is also reversed.

As illustrated in FIG. 11A, a sidewall 162 may be provided so as to have a predetermined angle θ toward the electromagnetic device 31 on at least one of the both right and left edges of the lower portion 16*b*2 of the hanging portion 16*b*. It is preferable that the predetermined angle θ is within 90 degrees with respect to the first face of the hanging portion 16*b* in order to reduce the magnetic resistance of the magnetic field (magnetic circuit) generated during energization of an overcurrent. The sidewall 162 may be formed by bending at least one of the both right and left edges of the lower portion 16*b*2 of the hanging portion 16*b* toward the electromagnetic device 31 side. The sidewall 162 is made of a magnetic substance.

In the cross section taken along a line A-A of FIG. 11A, as illustrated in FIG. 12A, a magnetic field (a magnetic circuit) is generated around the first movable piece 18*a* of the movable contact spring 18. When the sidewall 162 is formed on the hanging portion 16*b* as illustrated in FIG. 12A, a magnetic resistance of a magnetic field (magnetic circuit) generated during energization of the overcurrent is smaller than a case where the sidewall 162 is not formed on the hanging portion 16*b* as illustrated in FIG. 12B. Therefore, the movable contact spring 18 is pulled by a larger force by the armature 16.

As illustrated in FIG. 11B, a bottom wall 163 may be provided so as to have a predetermined angle θ toward the electromagnetic device 31 on the lower edge of the lower portion 160*j* of the hanging portion 160*b* of the armature 160. It is preferable that the predetermined angle θ is within 90 degrees with respect to the first face of the hanging portion 160*b* in order to reduce the magnetic resistance of the magnetic field (magnetic circuit) generated during energization of an overcurrent. The bottom wall 163 may be formed by bending the lower portion 160*j* of the hanging portion 160*b* toward the electromagnetic device 31 side. The bottom wall 163 is made of a magnetic substance.

In the cross section taken along a line A-A of FIG. 11B, as illustrated in FIG. 12C, a magnetic field (that is, a magnetic circuit) is generated around the lower portion 180*d* of the plate spring 180. When the bottom wall 163 is formed on the lower portion 160*j* as illustrated in FIG. 12C, a magnetic resistance of a magnetic field (magnetic circuit) generated during energization of the overcurrent is smaller than a case where the bottom wall 163 is not formed on the lower portion 160*j* as illustrated in FIG. 12D. Therefore, the plate spring 180 and the connection plate 181 fixed to the plate spring 180 are pulled by a larger force by the armature 160.

As mentioned above, in the second embodiment, the relay 110 has the connection plate 181 that has the movable contacts 36*a* and 36*b* connected to and separated from the fixed contacts 38*a* and 38*b*. The hanging portion 160*b* of the armature 160 has the projection 160*f* for fixing the movable plate spring 180 with caulking to the first face facing the electromagnetic device 31 and the lower portion 160*j* that extends downward more than the projection 160*f* and pulls the plate spring 180 and the connection plate 181 when a current flows between the fixed contacts 38*a* and 38*b* and the movable contacts 36*a* and 36*b*. Therefore, in the relay 110 of the embodiment, the current input from one fixed contact is output to the other fixed contact via the connection plate 181 having the movable contacts 36*a* and 36*b* on the both right and left edges thereof, that is, via a straight-shaped current path. Therefore, it is not necessary to provided current paths around the fixed contact and the movable contact. It is therefore possible to downsize the relay. Since the lower portion of the hanging portion 160*b* can pull the connection plate 181 and the plate spring 180 (that is, the lower portion 180*d*), it is not necessary to provide a new component for generating a pulling force between the movable contact and the fixed contact. The manufacturing cost can be reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

a pair of fixed contact terminals, each of which has a fixed contact;

a movable contact spring that has a pair of movable pieces and a coupler that couples the pair of movable pieces, each of the movable pieces having a movable contact that contacts and is separable from a respective fixed contact, wherein a current flows between the movable contacts via the pair of movable pieces and the coupler;

an armature that has a first portion to be attracted to an iron core and a second portion bent from the first portion and extending downward, and moves the movable contact spring by a rotation operation; and an electromagnetic device, including the iron core, that drives the armature, wherein the coupler is directly attached to an area of the second portion of the armature facing the electromagnetic device, and wherein the second portion of the armature has a pulling portion that extends downward more than the area and pulls the movable pieces of the movable contact spring when a current flows between the fixed contact and the movable contact.

2. The electromagnetic relay as claimed in claim 1, comprising:

a sidewall that stands on at least one of a left edge and a right edge of the pulling portion and toward the electromagnetic device, and is made of a magnetic substance.

3. An electromagnetic relay comprising:

a pair of fixed contact terminals, each of which has a fixed contact;

a movable contact spring that has a pair of movable pieces and a coupler that couples the pair of movable pieces, each of the pair of movable pieces having a movable contact that contacts and is separated from a respective fixed contact;

an armature that has a flat plate to be adsorbed to an iron core and a hanging portion bent from the flat plate and extending downward, and moves the movable contact spring by a rotation operation;

an electromagnetic device that drives the armature, wherein the hanging portion has a projection to fix the movable contact spring on a face thereof facing the electromagnetic device and a pulling portion that extends downward more than the projection and pulls the movable contact spring when a current flows between the fixed contact and the movable contact; and a sidewall that stands on at least one of a left edge and a right edge of the pulling portion and toward the electromagnetic device, and is made of a magnetic substance.

4. An electromagnetic relay comprising:

a pair of fixed contact terminals, each of which has a fixed contact;

a connection plate that has a pair of movable contacts, each of which contacts and is separated from a respective fixed contact;

a plate spring to which the connection plate is fixed;

an armature that has a flat plate to be adsorbed to an iron core and a hanging portion bent from the flat plate and extending downward, and moves the connection plate and the plate spring by a rotation operation;

an electromagnetic device that drives the armature, wherein the hanging portion has a projection to fix the plate spring on a face thereof facing the electromagnetic device and a pulling portion that extends downward more than the projection and pulls the plate spring and the connection plate when a current flows between the fixed contact and the movable contact; and a bottom wall that stands on a lower edge of the pulling portion and toward the electromagnetic device.

5. The electromagnetic relay as claimed in claim 4, wherein the plate spring is bent, and the hanging portion extends so as to overlap with the plate spring and the connection plate and is bent along a shape of the plate spring.

6. An electromagnetic relay comprising:

a pair of fixed contact terminals, each of which has a fixed contact;

a connection plate that has a pair of movable contacts, each of which contacts and is separated from a respective fixed contact;

a plate spring to which the connection plate is fixed;

an armature that has a flat plate to be adsorbed to an iron core and a hanging portion bent from the flat plate and extending downward, and moves the connection plate and the plate spring by a rotation operation;

an electromagnetic device that drives the armature, wherein the hanging portion has a projection to fix the plate spring on a face thereof facing the electromagnetic device and a pulling portion that extends downward more than the projection and pulls the plate spring and the connection plate when a current flows between the fixed contact and the movable contact, wherein:

the plate spring is bent; and the hanging portion extends so as to overlap with the plate spring and the connection plate and is bent along a shape of the plate spring.

7. An electromagnetic relay comprising:

a pair of fixed contact terminals, each of which has a fixed contact;

a movable contact spring that has a pair of movable pieces and a coupler that couples the pair of movable pieces, each of the movable pieces having a movable contact that contacts and is separable from a respective fixed contact, wherein a current flows between the movable contacts via the pair of movable pieces and the coupler;

an armature that has a first portion to be attracted to an iron core and a second portion bent from the first portion and extending downward, and moves the movable contact spring by a rotation operation;

an electromagnetic device, including the iron core, that drives the armature, wherein the second portion has a projection to fix the movable contact spring on a face thereof facing the electromagnetic device and a pulling portion that extends downward more than the projection and pulls the movable contact spring when a current flows between the fixed contact and the movable contact; and a sidewall that stands on at least one of a left edge and a right edge of the pulling portion and toward the electromagnetic device, and is made of a magnetic substance.

* * * * *